US006405387B1

(12) United States Patent
Barnes

(10) Patent No.: US 6,405,387 B1
(45) Date of Patent: Jun. 18, 2002

(54) SANITIZED JETTED BATHING FACILITY

(76) Inventor: Ronald L. Barnes, #74 Revere Way, Huntsville, AL (US) 35801

( * ) Notice: Subject to any disclaimer, the term of this patent is extended or adjusted under 35 U.S.C. 154(b) by 0 days.

(21) Appl. No.: 09/520,504

(22) Filed: Mar. 8, 2000

(51) Int. Cl.[7] ..... A61H 33/02
(52) U.S. Cl. ..... 4/541.2; 4/541.1
(58) Field of Search ..... 4/490, 541.1, 541.2, 4/541.3, 541.4

(56) References Cited

U.S. PATENT DOCUMENTS

| | | | | | |
|---|---|---|---|---|---|
| 4,043,913 | A | * | 8/1977 | Hintermeister | 4/541.1 X |
| 4,169,293 | A | * | 10/1979 | Weaver | 4/541.2 |
| 4,640,783 | A | * | 2/1987 | Kern | 4/490 X |
| 4,797,958 | A | * | 1/1989 | Guzzini | 4/541.2 |
| 4,829,607 | A | * | 5/1989 | Huse | 4/541.1 |
| 5,012,535 | A | * | 5/1991 | Klotzbach | 4/541.2 |
| 5,032,292 | A | * | 7/1991 | Conrad | 4/541.1 X |

FOREIGN PATENT DOCUMENTS

| | | | | |
|---|---|---|---|---|
| DE | 4231334 | * | 4/1993 | 4/541.1 |
| JP | 3158163 | * | 7/1991 | 4/541.1 |

* cited by examiner

*Primary Examiner*—Robert M. Fetsuga
(74) *Attorney, Agent, or Firm*—Mark Clodfelter

(57) ABSTRACT

Apparatus and method for sterilizing tubes and piping of a jetted tub or spa is disclosed. An ozone generator that operates by photodisassociation is connected to a tube connected to an air intake of the tub. A sensor detects when the tub is being filled, and initiates operation of the ozone generator, filling the tubing with ozone prior to water filling these tubes. Ozone may be provided to the water circulating through the tubes during operation in order to purify and sanitize the water. As the tub is being emptied, ozone continues to be provided to the tubes of the tub or spa as they empty, sterilizing these tubes in an empty state. In another embodiment, a timer may be connected to the ozone generator and sensor in order to operate the ozone generator for a selected period of time after the tub or spa is emptied. In yet another embodiment, aroma therapy may be combined with the ozone.

16 Claims, 3 Drawing Sheets

SANITIZED JETTED BATHING FACILITY

FIELD OF THE INVENTION

This invention relates to hot tubs, spas, jetted bathtubs and the like, and particularly to such a tub or spa provided with an ozone generator communicating with water and air conveying tubes of the tub for injecting ozone into these tubes in order to effect sterilization thereof.

BACKGROUND OF THE INVENTION

Hot tubs, spas and whirlpool bathtubs, in addition to whirlpool baths such as those found in hospitals, nursing homes and rehabilitation facilities, all circulate water between a water intake and jets positioned under the water level of the tub, spa or bath. In most instances, air from an adjustable air valve is mixed with the water to increase impingement thereof on the body and skin of the user to promote muscle relaxation.

In the case of spas and hot tubs, water is generally kept in the tub. This water should be changed relatively frequently, typically once a month or so. A sanitizer such as chlorine or bromine is used in a manner similar to sanitizer use in a pool, and the ph (level of acidity/alkalinity) is kept within a selected range. Where chlorine is used as a sanitizer, the level is generally maintained from about 1–3 parts per million, and should not be allowed to fluctuate. This level is sufficient to kill most bacteria and at least inhibit growth of other microbiota. However, this standard level of sanitizer will not fully prevent growth of algae, fungii and some protozoan lifeforms, such as amoeba, which may harbor colonies of organisms that cause Legionnaires disease.

In order to fully sterilize these tubs and spas, it is recommended that the water be "shocked", or the sanitizer level raised to a level, typically 8–15 parts per million of chlorine, sufficient to kill all microbiota in the water just prior to draining the tub or spa for refilling. The pump of the spa is operated for a sufficient period of time in order to allow the shocked water to circulate through all the pipes and tubes thereof, sterilizing all water-contacting surfaces of the spa. The shocked water, which contains contaminants such as chloramines, is then drained, and the sanitized tub or spa is then refilled with fresh water, the ph adjusted and sanitizer added. In the case of a jetted or whirlpool bathtub the water is simply drained after each use and refilled just prior to each use.

Problems with hot tubs and spas and other jetted bathing tubs or receptacles wherein water is kept therein over a period of time and reused is that if sanitizer levels are allowed to fluctuate then all manner of amoebas, bacteria, fungii, viruses, algae and other microbiota thrive on organic compounds present in the water. Harmful species of bacteria may also grow, such as *listeria monocytogenes,* which can cause pneumonia, meningitis and septisemia, and *pseudomonas aeruginosa,* which is responsible for pneumonia and skin rashes. While various strains of listeria may be eliminated by sanitizers and use of disinfectants, *pseudomonas aeruginosa* is a particularly resistant organism that defies many common sanitizers and antibiotics, and can grow at temperatures up to 42 degrees Celsius. Pseudomonas prefers moist and humid environments, and can survive even in distilled water. Worse yet, *Legionella pneumophilia,* the bacteria responsible for Legionnnaires disease, colonizes in amoebas that thrive in spas, hot tubs and jetted tubs, as well as showers, air conditioning evaporative cooling towers and other constantly wet or humid places. It is estimated that Legionnaires disease affects between 10,000–20,000 people per year, with a fatality rate of 5%–15% or more. Thousands more are probably infected, but are not severely sickened by the disease, developing only minor illness from the infections. In addition, it is generally impossible to physically clean the interior of water and air-conveying tubes of the tub or spa as with the exposed surfaces thereof. As such, a "bioslime" of algae and fungus builds up on these interior surfaces of the tubes that is not removed by shocking the water and is not penetrated by sanitizer, and which may harbor harmful colonies of organisms.

Accordingly, there is a need to better sanitize hot tubs, spas, and all manner of jetted tubs to eliminate the above mentioned and other disease-causing organisms that live and grow in the water and air-carrying tubes of these tubs and spas. It is another object of the invention to oxidize and remove the bioslime and other organic contaminants in the water and air-conveying tubes of jetted tubs and spas. Additional objects of the inventions will become clear upon a reading of the following specification.

SUMMARY OF THE INVENTION

An immersion facility is disclosed wherein an individual immerses his/her body therein for bathing, relaxation, therapy or the like. A receptacle is provided for holding a quantity of fluid sufficient for immersion of at least one person, the receptacle having at least one jet outlet mounted in an interior side thereof. A pump is provided to pump the fluid from a fluid inlet in the receptacle to the jet outlet, with tubing conventionally connecting between the fluid inlet, the pump and the jet outlet. An adjustable air valve is coupled to provide air to the stream of fluid emerging from the jet outlet, and an ozone generator is coupled to provide ozone to the air and water conveying tubing of the spa or tub. The ozone generator may be operated when the bathing facility is in use and to sterilize and remove contaminants from the water, and also may be operated when the facility is empty of fluid to sterilize and clean the fluid and air-conveying tubes of the facility.

BRIEF DESCRIPTIONS OF THE DRAWINGS

DETAILED DESCRIPTION OF THE DRAWINGS

Figure 1:
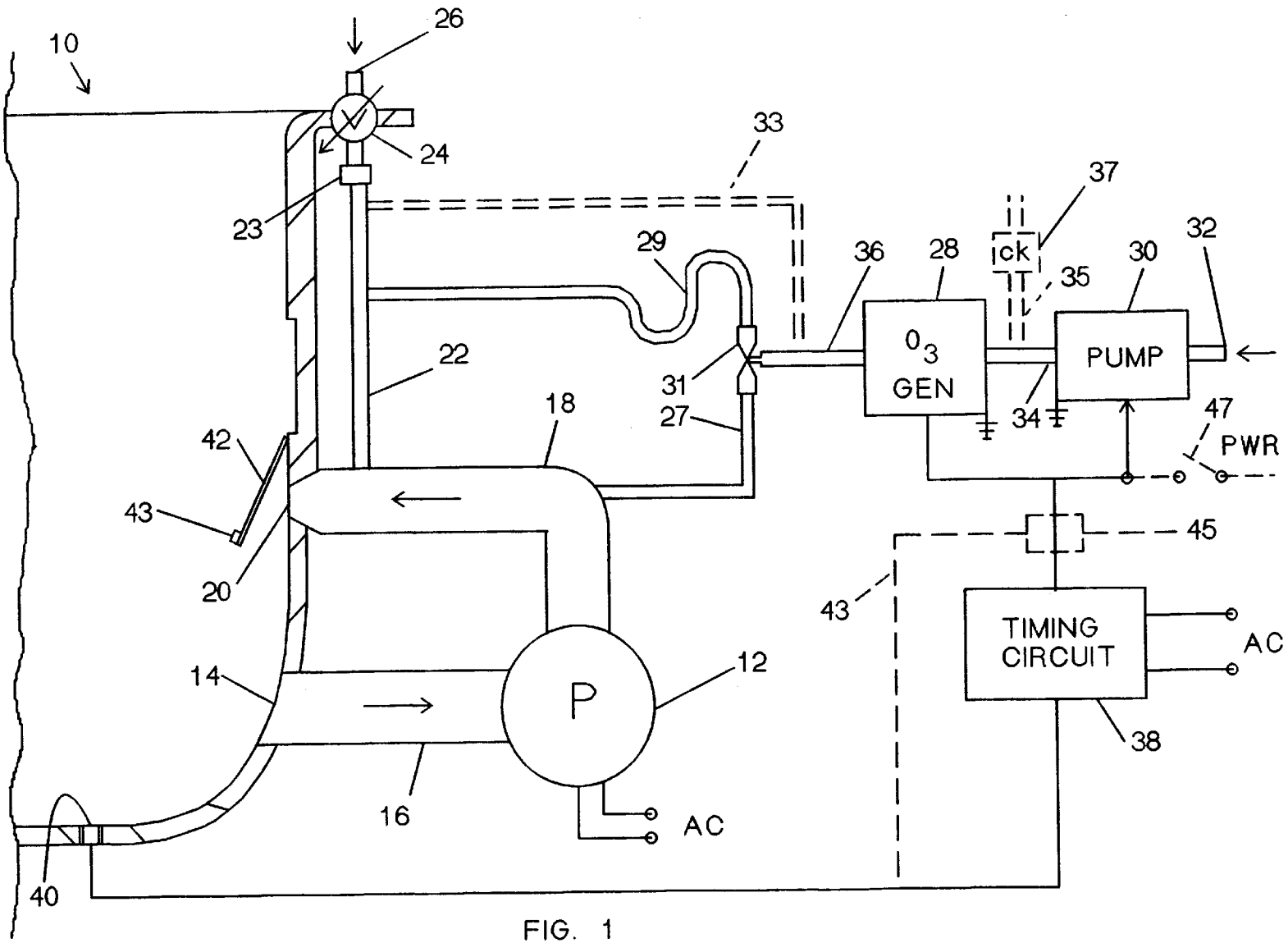
FIG. 1 is a schematic drawing of one embodiment of the invention.

Referring, by way of example, to FIG. 1, a broken-away portion of a hot tub, spa or jetted tub 10 is shown. Conventionally, a water pump and motor combination 12, hereinafter denoted as pump 12, draws water through an intake 14 from tub 10 through a tube or pipe 16 and provides relatively high pressure water via tube or pipe 18 to a jet 20. The water exits jet 20 in a high velocity stream and impinges on the user. In most instances, a tube 22 communicates between tube 18 and an adjustable air valve 24, the valve having an air intake 26. With this construction, valve 24 is adjustable to vary a quantity of air drawn by venturi principles into the high pressure stream of water exiting jet 20. While only one jet 20 is shown, it is to be understood that the majority of all such tubs are equipped with a plurality of jets and associated tubes or pipes 18 from pump 12, and at least 1 water intake 14. Also, it should be noted that during operation of pump and motor 12, a negative pressure will exist in tube 22 that tends to draw air thereinto.

For sterilizing and cleaning the interior of tubes 16, 18 and 22 as well as interior water-contacting surfaces of pump 12, Applicant proposes use of an ozone generator 28, which may be of the type that uses photodisassociation to break diatomic atmospheric oxygen (O2) apart whereupon each atomic oxygen atom combines with a diatomic oxygen molecule to form ozone (O3). Such an ozone generator may utilize a 30 watt ultraviolet discharge tube that emits ultraviolet light including a wavelength of 155 nanometers, which is known to break diatomic oxygen into atomic oxygen. This lamp is similar to a fluoroescent lamp tube, and produces from about 100 mg to about 400 mg per hour depending on airflow past the tube lamp. Here, airflow of about 5 liters per minute past the lamp tube generates ozone in the range of 100 mg per hour, while an airflow of 10 liters per minute generates ozone in the range of about 400 milligrams per hour. An airflow greater than about 10 liters per minute does'nt significantly produce more ozone, but reduces concentration of the ozone that is produced. Likewise, a lower airflow produces less ozone, but due to the reduced airflow, the concentration of ozone is increased. Alternately, a corona-type ozone generator may be employed.

An air pump or compressor 30 is used to pump air from an intake 32 via a tube 34 to and through ozone generator 28, and a tube 36 conveys air containing ozone, referred to as ozonated air, to a mixing device 31. Device 31 may be a venturi/mixer such as is commonly found in agriculturial applications where liquid concentrated fertilizer is mixed with water and subsequently sprayed or otherwise distributed to a crop, or it may simply be a T-type fitting. In the instance where device 31 is a venturi/mixer, ozone is mixed with a stream of water from pump 12 so that the bubble size is very small, greatly enhancing diffusion of ozone into the water. The device 31 may be connected in a bypass configuration as shown where some of the water from tube 18, being under pressure from pump 12, passes through a tube 27 to mixer 31 where the water is mixed with ozone, and thereafter the ozonated water flows through a contact section of tubing 29, diagrammatically shown as serpentine tubing. In a typical installation, this contact tubing would be something on the order of 4 to 6 feet or so, and allows thorough mixing and diffusing of the ozone into the water. The ozonized water then passes into tube 22 at or below air valve 24, where it is mixed with the water and air emerging from jet 20. A check valve 23 may be used to prevent any water from being expelled from valve 24. In another embodiment, as illustrated by dashed lines 33, ozonized air may be pumped or drawn directly from ozone generator 28 to tube 22, where it is provided to the water-carrying tube 18.

It is to be noted that when the tub or spa is in operation, the amount of air provided to ozone generator 28 may be limited by pump 30. This has the effect of increasing concentration of ozone provided to mixing device 31. By providing a bypass 35 and check valve 37 (dashed lines) a larger quantity of air may be freely drawn through mixer 31 by venturi principles. In this instance, airflow through the generator greatly exceeds 10 liters per minute so that the ozone is generated by the greater airflow through generator 28 is at a lower concentration. This tends to reduce outgassing of the ozone from the tub during use. Conversly, when the tub is in a dry state, operation of pump 30 develops less airflow through generator 28 with a corresponding increase of ozone concentration. During this mode of operation, it is desirable that the airflow be selected so as to produce the most concentrated levels of ozone, which when constrained within the tubes of the tub, as will be explained, completely sanitizes and oxidizes bioslime within these tubes, eliminating the possibility of providing an environment conducive to growth of harmful microbiota therein.

A timing circuit 38 is coupled to ozone generator 28 and pump 30, and may be used to energize pump 30 and ozone generator 28 for selected intervals of time. In one embodiment, a water sensor 40 provided in tub 10 is used in conjunction with timing circuit 38 to indicate presence or absence of water in tub 10, as when the tub is being filled for use. Where tub 10 is a hot tub, spa or the like, a float switch or other similar switch may be conveniently positioned so as to sense and provide a signal indicative of an empty condition of the tub. In this instance, such an empty condition could be opportunistically used to clean and sanitize the tubes of the tub or spa. Here, the timing circuit would activate ozone generator 28 and pump 30 for a predetermined period of time, such as 30 minutes or so. In the case of a jetted tub that is filled and emptied with each use, the timer may be used to activate ozone generator 28 and pump 30 upon detection of water in the tub, such as when it is being filled to pump a relatively higher concentration of ozone through the empty tubes of the tub. After the tub is filled, ozone generator 28 and pump 30 would operate either for a period of time sufficient for a person to bathe and empty the tub of water or upon detection of an empty condition of the tub. After the tub is emptied, it is anticipated that ozone generator 28 and pump 30 may operate for a selected time interval, such as 15 minutes or so, in order to allow the higher concentrations of ozone to suffuse through the system of tubes, pipes and pump in order to sterilize the interiors thereof after use.

The ozone would be generally constrained within the tubes, pipes and pump by a valve 42 that blocks jet 20, which valve 42 may be a flap valve that simply lowers by gravety to cover the opening of the jet when the tub is empty. As shown, a recess or clearance may also be provided for the valve so that when open, it does not protrude into the tub. Also, the valve 42 is shown in FIG. 1 as being of exaggerated size, it need only be slightly larger than the jet opening and be hinged just above the opening. Alternately, a check valve may be incorporated in the jet or tubing near the jet, such a valve being of the type wherein low impedance is presented to water flowing to the jet during operation. After the water level in the tub is above the flap valve, the flap valve floats to a generally vertical position so that the jet is open, this floating action being facilitated by either a buoyant material 43 fixed to flap 42, or the flap itself may be constructed of a buoyant material. When sterilizing the tubes and pipes of the tub, air valve 24 may be manually closed, thus the closed air valve and flaps over the jets generally prevent escape of the ozonated air from the pipes and tubes around the tub. A one-way or other type valve may be placed in tubing 16 to prevent escape of ozone, but it is believed the impeller blades in pump 12 would generally prevent larger quantities of ozone from escaping from intake 14. Here, leakage of ozone around the impeller blades of pump 12 should be sufficient to sterilize tube or pipe 16 when it is empty of water. With air valve 26 closed and flap valve 42 blocking jet 20 as described, ozone concentration rapidly builds up within the air and water-conveying pipes and tubes of the tub, killing any microbiota therein including protozoa, algae, molds, fungii, bacteria, viruses and others. Also, the bioslime coat that otherwise would accumulate on the interior surfaces of these tubes is oxidized by the higher concentrations of ozone, and is subsequently removed by the high rate of water flow through the tubes during use. After the tub or spa is filled with water, the timing circuit may be activated to energize ozone generator 28 and pump 30 for selected intervals as described, or ozone generator 28 and pump 30 may simply be operated continuously as long as pump 12 is operated. This injects ozone at a lower concentration directly into the circulating water, sterilizing the water of the tub and oxidizing contaminants therein while preventing algae and other microorganisms from colonizing either within the tub or within the tubes and pipes thereof. Alternately, as shown by dashed line 43, the timing circuit 38 may be omitted, with sensor 40 coupled to a switch, such as a latching relay (schematically illustrated at dashed line box 45), that maintains operation of ozone generator 30 as long as there is water contacting sensor 40, i.e. water in the bottom of tub or receptacle 10. Thus, as water is first being introduced into tub 10 and before the water level rises to a point where it enters the jet tubing, and possibly before it enters the intake tubing where such an intake is mounted to a side wall of the tub, ozone generator 28 and pump 30 are energized to pump a higher concentration of ozone into the empty tubes of the tub. This sterilizes and cleans these tubes prior to water being introduced thereinto. Likewise, as water is being drained from the tub, the ozone generator continues to operate until the water no longer covers sensor 40, allowing ozone to be pumped through the emptying tubes of the tub, sterilizing these tubes after use. In a variant of this embodiment, a switch 47 (dashed lines) may be used to manually switch the ozone generator and associated pump 30 "on" and "off". This embodiment may be more applicable to larger spa or hot tub where water is retained therein for longer periods of time. In this instance, during a water change, the ozone generator may be switched "on" after the tub is emptied, and may be left to operate for a longer period of time, possibly for hours, in order to allow the ozone to penetrate into every crack and crevice of the tubing, valves and pump of the system. The ozone generator may be also switched "on" while the tub or spa is in operation in order to sanitize the water and oxidize contaminants therein. Of course, a manual switch may also be used to operate an ozone generator used on a smaller jetted tub.

There is at least one jetted tub manufacturer constructing jetted tubs wherein a smaller pump and motor assembly is used for each jet, with the output of each pump of each pump and motor assembly coupled directly to a jet in the tub. Thus, in this construction, a plurality of pump and motor assemblies are mounted directly against the outer wall of the tub. Here, air from a valve such as valve 24 communicates with the suction line for each pump so that the pumps draw a mixture of air and water. In this instance, ozone may be provided to this air line in a similar manner to line 33 (dashed lines in FIG. 1), allowing ozonated air to be drawn into the mixture of air and water. Turbulance in the pump would assist in diffusing the ozone into the water. When the tub is empty of water, as before or after use, the air valve may be closed and the ozone generator and pump combination activated, pumping ozonated air through the tubes and piping of the tub. Impeller blades at each pump would allow concentration of ozone to build up to sanitizing levels while allowing any positive pressure to escape, sterilizing the pump and jet in the process.

Figure 2:
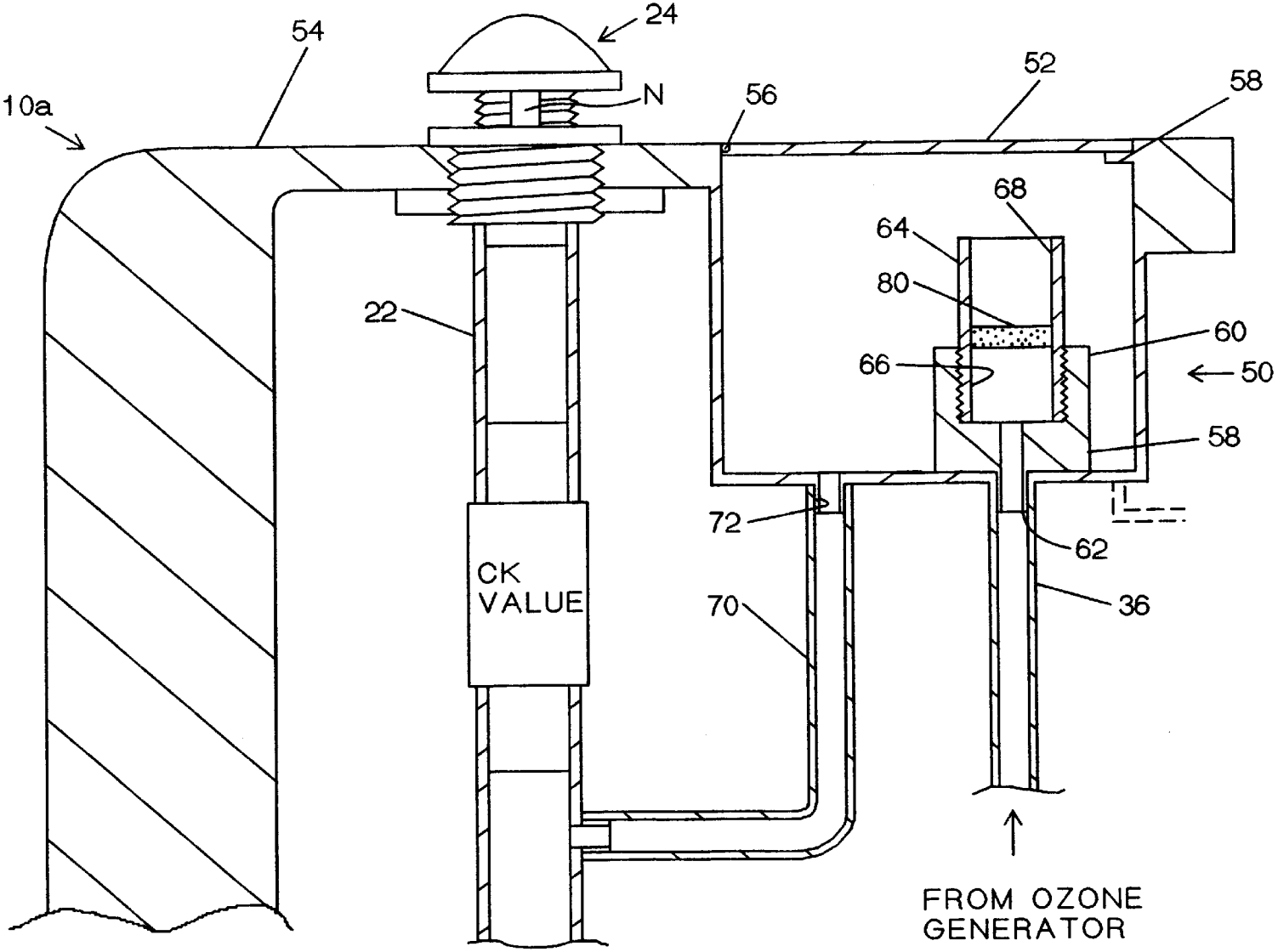
FIG. 2 is a schematic drawing of a second embodiment of the invention.

In another embodiment wherein structure for providing aromatherapy is incorporated in the tub, such structure may be combined with an ozone generator. Referring to FIG. 2, a jetted tub or spa 10*a* (shown broken away) may incorporate an enclosure 50 having a closure 52 that may be generally flush with an upper surface of the tub edge, and bearing against a lip or flange 54 extending around an opening of the enclosure. Closure 52 preferably would be constructed so as to seal enclosure 50 generally airtight during operation, as should be evident to one skilled I the art. Closure 52 may be attached to tub 10*a* as by a hinge 56, or closure 52 may be a freely removable cover, and provided with convenient means for lifting (not shown), such as a knob, as also should be apparent to one skilled in the art.

Inside enclosure 50 is provided an adapter 58 having a relatively wide, female threaded region 60 extending into an interior of enclosure 50, and a port 62 adapted to receive a tube, such as tube 36, from ozone generator 28 (FIG. 1). In this embodiment, a second ozone generator may be used, or a larger ozone generator than that described for FIG. 1 (30 watt) may be used and the flow therefrom divided between injector/mixer 31 and enclosure 50.

A cylindrical housing 64 open at both ends is threaded at an end 66 to threadably engage female threaded region 60 of adapter 58, and end 68 of housing 64 may be left open. A tube 70 is connected to a port 72 on an exterior of enclosure 50, tube 70 communicating between air tube 22 and port 72, as by a T-fitting. With this construction, aromatherapy vapor and ozone from port 72 is drawn into the airstream flowing through tube 22 from valve 24. Thus, valve 24 may be adjusted by a user to vary a quantity of air, ozone and aromatherapy available to the jets of the tub or spa. If desired, a second valve may be provided in line 70 to vary the quantity of ozone and aromatherapy independently of air available from valve 24. Of course, the parts exposed at least to higher concentrations of ozone would be constructed of materials resistant to attack by the ozone, as should be apparent to one skilled in the art.

Inside housing 64 is mounted a diffuser 80, which may be a disk of a sintered material, such as stainless steel, through which ozone from ozone generator 28 is passed, the ozone possibly reacting with selected aroma therapy compounds to provide a more intense or theraputic aroma therapy. Diffuser 80 serves to receive compounds, generally in liquid form, used in aroma therapy and other scented compounds, the vapor from these compounds being drawn into the airstream for the tub or spa jets and thereafter into the water of the tub. Due to the relatively large bubble size produced by mixing of air, aromatherapy vapor and ozone at jet 20, little diffusion into the water of the aromatherapy vapor and ozone would occur prior to the bubbles rising to the surface and scenting the air above and around the tub with the aromatherapy scent and ozone. As is known, ozone is produced in nature during thunderstorms and other natural phenomana, the scent of which being associated with a "freshness" and "outdoorsy" quality. To this end, quantity of ozone from the ozone generator may be regulated or metered to aromatherapy enclosure 50 as by a valve or constriction in tube 36. In this instance, extra air may be provided in enclosiure 50, as by an extra air port 63 (dashed lines) sized to allow a selected quantity of air to be drawn into enclosure 50.

While a diffuser of a sintered material is disclosed, the diffuser may be constructed of any suitable material in any form that would pass ozone and receive an aromatherapy compound that would impart a particular scent to the air circulating over and around through the tub. In a varient of the embodiment shown in FIG. 2, the diffuser structure may be placed directly in the airstream from valve 24 and be provided with a port to draw ozone from ozone generator 38.

Housing 64 containing diffuser 80 is constructed to be easily replacable so that a user may readily remove a housing 64 containing one aromatherapy compound and replace it with another housing 64 and diffuser 80 having a different aromatherapy compound thereon. Here, the user simply opens closure 52 and unscrews housing 64 from adapter 58 and replaces that housing 64 with another housing 64 containing the different aromatherapy compound. This eliminates the need to clean housing 64 and diffuser 80 each time a different aroma therapy compound is desired to be used. As such, a user may purchase separately or be provided with a collection of housings 64, each with its own distinct aromatherapy compound so that the user may select a particular aroma or other compound according to his/her preferences. In the instance where the aroma in a housing 64 fades, the user may simply renew the aroma by placing a drop or so of the aromatherapy compound in its liquid form onto the diffuser 80 or elsewhere within housing 64.

Figure 3:
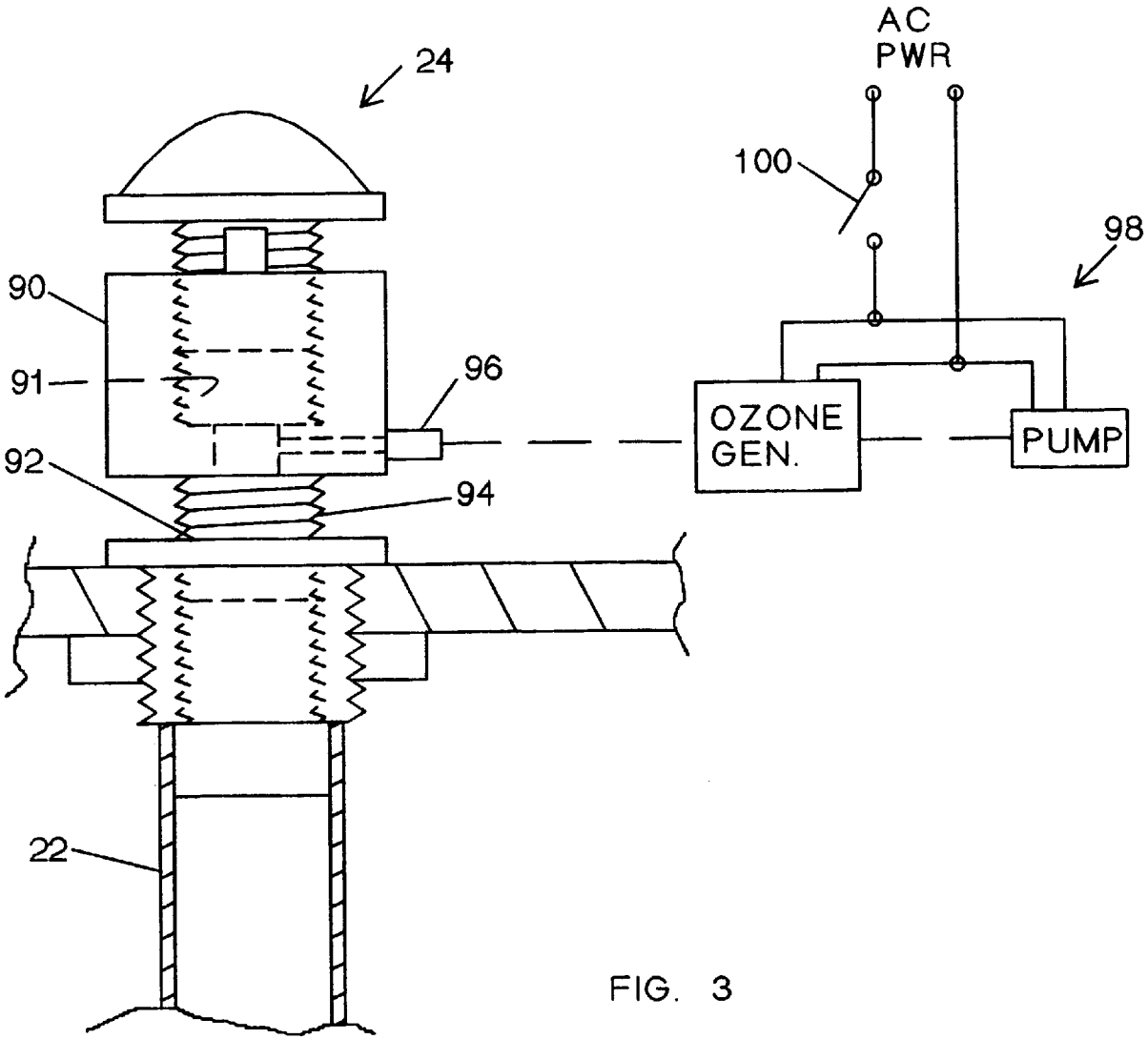
FIG. 3 is a diagrammatic view of an embodiment of the invention for retrofit to a jetted tub or spa.

In an embodiment for retrofitting an existing installed jetted tub or spa with an ozone generator, reference is made to FIG. 3. Here, the air valve 24 (FIG. 1), which in most instances is a threaded plug having a notch N running the length of the threaded portion is replaced by an adapter 90, shown partially threaded into opening 92 that otherwise would receive valve 24. Adapter 90 may be constructed including a valve 24, or the existing valve 24 removed from opening 92 in order to accommodate adapter 90 may be threaded into opening 91 (dashed lines) of adapter 90. Opening 91 in turn communicates with tube 22 via an opening through threaded portion 94 of adapter 90. A port 96 may be provided in adapter 90, port 96 coupled to an ozone generator and pump 98 located or mounted inside the access area of the tub or remote from the tub. A switch 100 may be provided to switch generater and pump 98 ON and OFF. Flap valves may be installed over each jet, or plugs may be provided to plug the jets, these plugs having a relief mechanism to prevent positive pressure from building up within the tubes and piping of the tub. Here, and in the other embodiments, some airflow through the jets is necessary in order to displace air therein with ozonated air.

In use, and referring to FIG. 1, as a user of a jetted tub begins to fill the tub 10, sensor 40 detects the presence of water filling the tub, and provides a signal to timing circuit 38. Circuit 38 is initialized responsive to the signal from sensor 40, and provides an energizing current to ozone generator 28 and pump 30, which begin to pump a higher concentration of ozone into the water and air conveying tubes of the tub. With the flaps 42 covering the jets and air valve 24 closed by the user, ozone concentration rapidly increases within the tubes of the tub, serving to immediately sterilize the interior of these tubes and oxidize contaminants therein prior to water filling the tub. Any positive pressure building up in the tubes is released by at least one of the flaps briefly opening to relieve the pressure. Timing circuit 28 may be set to cause ozone generator 28 and pump 30 to operate after the tub is filled, sterilizing the water as it is circulated through the tubes. Alternately, as described, a switch may be used to activate ozone generator 28 and pump 30 prior to use. As sensor 40 may also detect when the tub is emptied, the timing circuit may be set to operate ozone generator 28 and pump 30 for a short interval after the tub is emptied, insuring the tubes are sterilized after use. Where a switch is used, generator 28 and pump 30 may simply be left ON for a period of time after the tub is drained. Circuit 38 or the switched embodiment may further incorporate a clock in order to operate ozone generator 28 and pump 30 on a daily basis for a relatively short interval, such as 15 minutes or so, at a time when the tub is not in use, such as in the middle of the night or during the day, so as to daily sterilize the tubes at a preset time.

In the instance of a spa where the water is maintained in a manner similar to a swimming pool, timing circuit 38 may be set to energize ozone generator 28 and pump 30 for a preset period of time upon activation of pump 12, i.e. when the spa is in use. Additionally, a clock as described above may be set to initiate operation of pump 12, ozone generator 28 and pump 30 for a preset interval on a daily basis in order to sterilize water in the spa. Additionally, when the water is changed, a sensor 40, float switch or a manual switch as described above may be incorporated to sterilize the tubes and oxidize contaminants when they are emptied of water. Additionally, the ozone generator as described may be used in combination with conventional sanitizers to sterilize a tub or spa.

The embodiment of FIG. 2 would operate as described above, with the user selecting a particular aroma or scent to be imparted into the air over and around the tub. As described, to change the aromatherapy, the user merely opens closure 52 and unscrews one housing 64 containing one aromatherapy and replaces it with another housing 64 containing a different aromatherapy, after which the ozone generator and pump would be ready for operation. In this embodiment, the ozone flowing therethrough would also keep the environment of the aromatherapy structure sterile.

In order to sterilize the tubes of the tub or spa using the embodiment of FIG. 3, air valve 24 is closed and switch 100 operated to energize generator and pump 98. This pumps a higher concentration of ozone into the empty pipes and tubes of the tub. After the tub is filled, valve 24 may be opened to provide a mix of ozone and air to water of the tub, although less diffusion of ozone into the water in the tub would occur due to larger bubble size, as earlier described.

After having thus described my invention and the manner of its use, it is apparent that incidental changes may be made thereto that fairly fall within the scope of the following appended claims, wherein I claim:

1. An immersion facility such as a spa, hot tub or the like comprising:

a receptacle suitable for holding a quantity of fluid sufficient for immersing a body of at least 1 person therein, at least one jet outlet in an interior side of said receptacle, a fluid pump coupled by first tubing to a fluid intake in said receptacle, said fluid pump also coupled by second tubing to said jet outlet so that said fluid is drawn into said fluid intake and propelled out said jet, third tubing coupled to said second tubing, said third tubing having an air intake at one end and an air valve in said third tubing for controlling a flow of air provided to said fluid flowing to said jet outlet in order to mix air into said fluid emerging from said jet, an ozone generator having an air pump and coupled to said third tubing so that ozone is provided to said third tubing and subsequently to all said tubing and said fluid pump of said receptacle, a fluid presence sensor providing an output signal responsive to presence of fluid in said receptacle, said output signal coupled to energize said ozone generator, a valve positioned to generally close a jet exit for said fluid, said valve operable in an absence of water flowing in said tubes, generally constraining said ozone in an absence of water within said first tubing, said second tubing, and said pump.

2. A facility as set forth in claim 1 wherein said ozone generator is coupled to said second tube to provide ozone to at least said second tube.

3. A facility as set forth in claim 1 further comprising a fourth tube connected to said third tube and to said ozone generator, so that air and ozone is provided by said ozone generator through said fourth tube to said tubes of said receptacle and said pump.

4. A facility as set forth in claim 1 further comprising a timing circuit responsive to said sensor and coupled to said ozone generator so that said ozone generator provides ozone to said first, second and third tubing and said pump when said receptacle is being filled and emptied of said fluid and at least for selected periods of time during operation of said facility.

5. A facility as set forth in claim 4 wherein said ozone generator is operated only responsive to fluid being present in said receptacle so that said ozone generator provides ozone to said first, second and third tubing and said pump when said receptacle is being filled and emptied of said fluid and at least for selected periods of time during operation of said facility.

6. A facility as set forth in claim 1 further comprising a valve positioned to generally close a jet exit for said fluid, said valve operable in the absence of water flowing in said tubes, generally constraining said ozone in an absence of water within at least said first tubing, said second tubing and said pump.

7. An immersion facility of the class including hot tubs, spas and similar facilities for holding a quantity of fluid sufficient for immersing a body of at least one person therein and comprising, a fluid circulation system further comprising:

a fluid inlet for drawing said fluid from said immersion facility, a motor-driven pump coupled to said fluid inlet, a fluid outlet from said pump coupled to an interior of said immersion facility so that said fluid is drawn through said fluid inlet and directed back into said immersion facility through said fluid outlet, an air inlet coupled to said fluid circulation system so that air may be drawn into said fluid circulation system, and, an ozone generator coupled to said fluid circulation system, an air pump coupled to said ozone generator for pumping air through said ozone generator and into said fluid circulation system, and operable to pump ozone gas into said fluid circulation system when said fluid circulation system is empty of said fluid, a selectable timer coupled to said ozone generator and said air pump for operating said ozone generator and said air pump for selected periods of time when said circulation system is generally empty of said fluid, thereby providing ozone as a sanitizing gas to interior surfaces of said circulation system.

8. An immersion facility as set forth in claim 7 further comprising a selectable timer coupled to said ozone generator and said air pump for operating at least said ozone, generator and said air pump for selected periods of time.

9. An immersion facility as set forth in claim 1 further comprising a fluid sensor coupled to initiate operation of said ozone generator and said air pump for a selected period of time during filling and emptying of said fluid into and from said receptacle.

10. An immersion facility as set forth in claim 9 wherein said ozone generator and said air pump are operated when said circulation system is generally empty of said fluid, thereby providing ozone as a sanitizing gas to interior surfaces of said circulation system.

11. An immersion facility as set forth in claim 9 wherein said ozone generator and said air pump are is operated during filling and emptying of said fluid into and from said receptacle.

12. An immersion facility as set forth in claim 7 wherein during operation of said fluid circulation system, more air is drawn through said ozone generator than can be provided by said pump alone, whereby a concentration of ozone in said air from said ozone generator is lower, and in an absence of water in said fluid circulation system and said immersion facility said ozone generator and said air pump provide a higher concentration of ozone to interior surfaces of said fluid circulation system and tubes of said air inlet system.

13. A spa, hot tub or similar jetted tub comprising:

a water circulation system further comprising:

a water pump, at least one water inlet in said spa, hot tub or similar jetted tub, said inlet communicating with a water intake of said water pump, at least one water outlet in at least a wall of said spa, hot tub or similar jetted tub, said water outlet communicating with a water output of said water pump and configured to provide a jet of water into said spa, hot tub or similar jetted tub, and an air intake system coupled to said circulation system so that air is provided to said jet of water issuing from said jet, an ozone generator coupled to said air intake system and operable to provide ozone to said air intake system and said water circulation system during an absence of water flowing through said water circulation system, exposing inner surfaces of said water circulation system and said air intake system to ozone in a gaseous form.

14. A spa, hot tub or similar jetted tub as set forth in claim 13 wherein said air intake system is adjustable to provide a selected flow of said air drawn into said water circulation system by suction from said water pump, with said ozone also being drawn into said water circulation system during operation of said water pump.

15. A spa, hot tub or similar jetted tub as set forth in claim 13 wherein said air intake system further comprises:

an adjustable air valve on an exterior region of said spa, hot tub or similar jetted tub, said adjustable air valve having a removable portion operable to selectively vary said flow of air, an adapter coupled to said ozone generator and configured to replace said removable portion in said air valve so that said ozone may be introduced into said air intake system via said adjustable air valve.

16. A spa, hot tub or similar jetted tub as set forth in claim 13 wherein said ozone is provided in a higher concentration during said absence of water flowing through said water circulation system, and said ozone is provided at a lower concentration during operation of said water circulation system and said air intake system.

* * * * *